US007906170B2

(12) United States Patent
Schafer et al.

(10) Patent No.: US 7,906,170 B2
(45) Date of Patent: Mar. 15, 2011

(54) APPARATUS, METHOD, AND SYSTEM CAPABLE OF PRODUCING A MOVEABLE MAGNETIC FIELD

(75) Inventors: Adam J. Schafer, Portland, OR (US); Arnel M. Fajardo, Beaverton, OR (US); Chang-Min Park, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 969 days.

(21) Appl. No.: 11/729,193

(22) Filed: Mar. 27, 2007

(65) Prior Publication Data

US 2008/0238593 A1 Oct. 2, 2008

(51) Int. Cl.
*H01F 1/00* (2006.01)
*H01F 3/00* (2006.01)
*H01F 7/00* (2006.01)

(52) U.S. Cl. ..... 427/128; 335/296

(58) Field of Classification Search ..... 335/296, 335/306; 427/128; 428/689
See application file for complete search history.

(56) References Cited

U.S. PATENT DOCUMENTS 4,721,553 A * 1/1988 Saito et al. ..... 204/192.12
5,308,417 A * 5/1994 Groechel et al. ..... 216/67
5,858,180 A * 1/1999 Hsu ..... 204/192.12
5,926,414 A * 7/1999 McDowell et al. ..... 365/170
5,998,048 A * 12/1999 Jin et al. ..... 428/836.3
6,014,943 A * 1/2000 Arami et al. ..... 118/723 E
6,187,160 B1 * 2/2001 Rick et al. ..... 204/298.22
6,207,472 B1 * 3/2001 Callegari et al. ..... 438/99
6,249,200 B1 * 6/2001 Stelter et al. ..... 335/302
6,500,745 B1 * 12/2002 Ikegami ..... 438/595
6,616,816 B2 * 9/2003 Sakai ..... 204/192.1
6,662,432 B2 * 12/2003 Balamane et al. ..... 29/603.07
6,716,302 B2 * 4/2004 Carducci et al. ..... 156/345.47
6,743,340 B2 * 6/2004 Fu ..... 204/192.12
7,374,636 B2 * 5/2008 Horioka et al. ..... 156/345.46
2004/0033697 A1 * 2/2004 Kumar et al. ..... 438/710
2004/0188239 A1 * 9/2004 Robison et al. ..... 204/192.3
2004/0216667 A1 * 11/2004 Mitsuhashi et al. ..... 118/715

* cited by examiner

*Primary Examiner* — Elvin G Enad
*Assistant Examiner* — Alexander Talpalatskiy
(74) *Attorney, Agent, or Firm* — Kenneth A. Nelson

(57) ABSTRACT

An apparatus capable of producing a moveable magnetic field includes a moveable support structure (110) and a magnetic field source (120) supported by the moveable support structure, where the magnetic field source is in a fixed position relative to the moveable support structure. The magnetic field source generates a magnetic field at a wafer surface of at least approximately 50 Oersted, and the magnetic field is aligned so as to produce magnetic anisotropy in a plane of the moveable support structure.

6 Claims, 2 Drawing Sheets

APPARATUS, METHOD, AND SYSTEM CAPABLE OF PRODUCING A MOVEABLE MAGNETIC FIELD

FIELD OF THE INVENTION

The disclosed embodiments of the invention relate generally to semiconductor wafer manufacturing, and relate more particularly to magnetic fields used during semiconductor wafer manufacturing.

BACKGROUND OF THE INVENTION

A key requirement for the production of magnetic films for microelectronic inductors is the deposition of aligned, soft magnetic fields onto full wafers. Any capital equipment to support this film deposition will need to incorporate a solution that maintains the magnetic field alignment or risk a high degree of magnetic isotropy where, undesirably, the magnetic domains are oriented randomly. Some existing electroplating systems do have a magnetic field aligned to a deposition chamber, yet these systems only apply the magnetic field to a stationary substrate, and thus suffer from limitations in terms of temperature control and thickness uniformity. Accordingly, there exists a need for a plating tool with an applied magnetic field that is rigidly linked to a moving wafer.

BRIEF DESCRIPTION OF THE DRAWINGS

The disclosed embodiments will be better understood from a reading of the following detailed description, taken in conjunction with the accompanying figures in the drawings in which.

Figure 1:
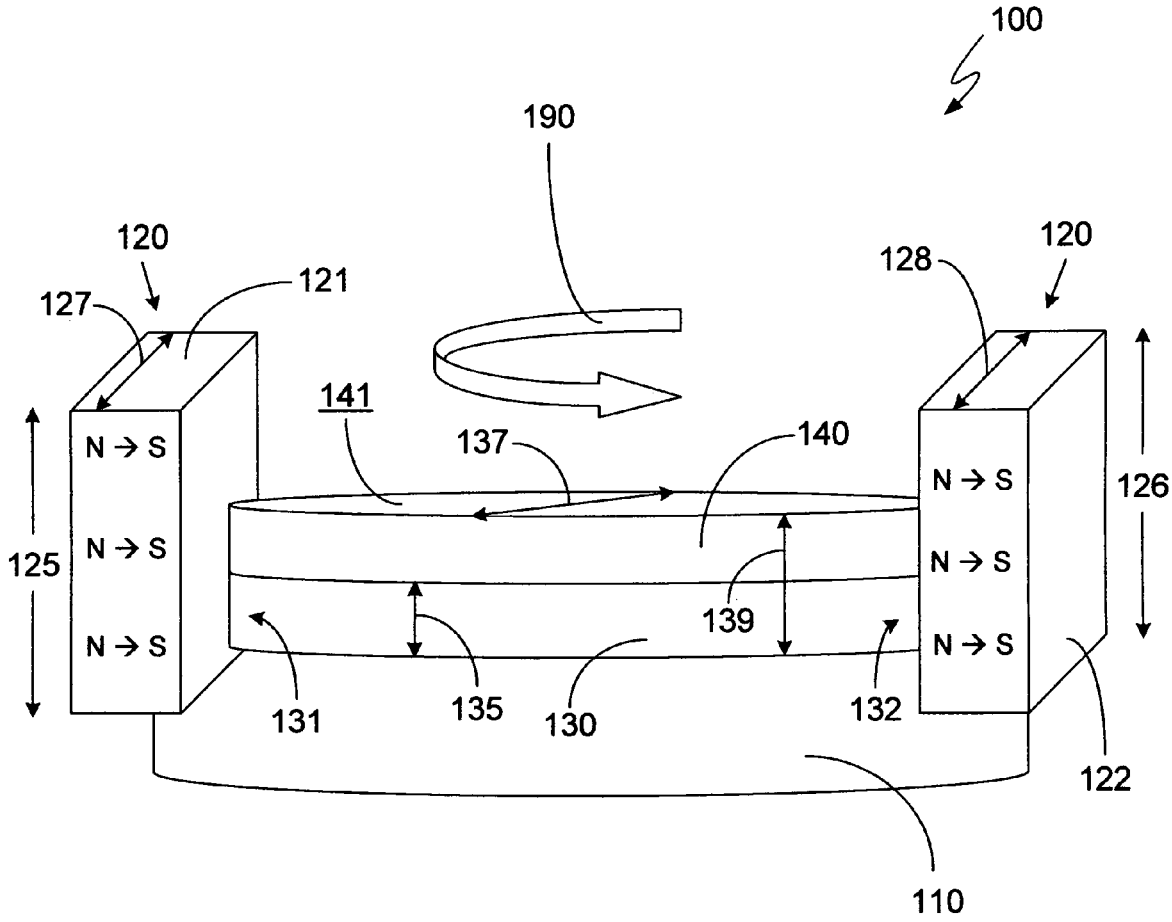
FIG. 1 is a perspective view of an apparatus capable of producing a moveable magnetic field according to an embodiment of the invention.

For simplicity and clarity of illustration, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method. Furthermore, the terms "comprise," "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical or non-electrical manner. Objects described herein as being "adjacent to" each other may be in physical contact with each other, in close proximity to each other, or in the same general region or area as each other, as appropriate for the context in which the phrase is used.

DETAILED DESCRIPTION OF THE DRAWINGS

In one embodiment of the invention, an apparatus capable of producing a moveable magnetic field comprises a moveable support structure and a magnetic field source supported by the moveable support structure, where the magnetic field source is in a fixed position relative to the moveable support structure. The magnetic field source generates a magnetic field at a wafer surface of at least approximately 50 Oersted (Oe) (for some embodiments the magnetic field strength is at least approximately 250 Oe), and the magnetic field is aligned so as to produce magnetic anisotropy in a plane of the moveable support structure. Embodiments of the invention will enable wafer movement while the magnetic field is fixed relative to the wafer, which may produce better temperature control and thickness uniformity than is possible with stationary systems. More specifically, temperature fluctuations may lead to unwanted fluctuations in the deposited thin magnetic film, and thickness variations can lead to processing problems later on in the semiconductor manufacturing process.

The synchronized movement of a magnetic field with a moving wafer or wafers such that the wafer(s) are always in a constant magnetic environment, as made possible by embodiments of the present invention, allows for the production of an integrated silicon voltage regulator (ISVR), another inductor application, or the like having well-defined magnetic properties, e.g, having magnetic anisotropy in the plane of the wafer. Embodiments of the invention may accomplish this by taking the natural domains of a thin magnetic film and aligning them in a single direction. The application of an aligned magnetic field during deposition can significantly reduce the coercivity of the resulting magnetic film. The target coercivity of soft magnetic materials for ISVR applications is less than 1 Oe, to minimize transformer power losses.

Referring now to the figures, FIG. 1 is a perspective view of an apparatus 100 capable of producing a moveable magnetic field according to an embodiment of the invention. As illustrated in FIG. 1, apparatus 100 comprises a moveable support structure 110 and a magnetic field source 120 supported by moveable support structure 110. Magnetic field source 120 is in a fixed position relative to moveable support structure 110. In one embodiment, moveable support structure 110 rotates in the direction of an arrow 190. In a different embodiment, the rotation could be in another direction.

In one embodiment, magnetic field source 120 generates a magnetic field at a wafer surface of at least approximately 50 Oe (with even higher field strengths—perhaps as high as 250

Oe or even higher—generally preferred for at least some embodiments), and the resulting magnetic field is aligned so as to produce magnetic anisotropy in a plane of moveable support structure 110. In other words, and as further discussed below, magnetic field source 120 may be arranged such that it produces a continuous straight magnetic field across a substrate or wafer in the plane of a film during deposition. In other words, magnetic field source 120 may be arranged such that it produces parallel or substantially parallel field lines at all or substantially all locations on the wafer or wafers being processed.

In one embodiment, moveable support structure 110 and magnetic field source 120 may be integrated within a plating tool (not shown). In one embodiment, magnetic field source 120 is a permanent magnet, while in a different embodiment, magnetic field source 120 is an electromagnet. Permanent magnets are likely much heavier than electromagnets (weighing perhaps one hundred pounds or more for a 250 Oe field strength) but are simpler and produce straighter north-south magnetic field lines.

Moveable support structure 110 is capable of receiving a semiconducting wafer 130 on which a magnetic film 140 may be deposited, and moveable support structure 110 is further capable of holding semiconducting wafer 130 in the plane of moveable support structure 110. As an example, the plane of moveable support structure 110 can be substantially parallel to a surface 141 of magnetic film 140 and to a surface of semiconducting wafer 130. In one embodiment, magnetic film 140 has a coercivity of less than approximately 1.0 Oe. In the same or another embodiment, magnetic film 140 comprises cobalt and at least one of tungsten, boron, iron, and phosphorus.

In the illustrated embodiment, semiconducting wafer 130 has a side 131 and an opposing side 132, and magnetic field source 120 comprises a permanent magnetic bar 121 located at side 131 and a permanent magnetic bar 122 located at side 132. As illustrated, permanent magnetic bar 121 has a first axis with a north pole at a first end thereof and a south pole at an opposing second end thereof, and permanent magnetic bar 122 has a second axis with a north pole at a first end thereof and a south pole at an opposing second end thereof. Note that permanent magnetic bars 121 and 122 are thus aligned in attraction with each other. In one embodiment, magnetic field source 120 comprises a first plurality of permanent magnetic bars, including permanent magnetic bar 121, located at side 131 of semiconducting wafer 130 and further comprises a second plurality of permanent magnetic bars, including permanent magnetic bar 122, located at side 132 of semiconducting wafer 130.

As illustrated in FIG. 1, permanent magnetic bar 121 has a height 125 and permanent magnetic bar 122 has a height 126. Semiconducting wafer 130 has a height 135. In one embodiment, height 125 and height 126 are each at least as great as height 135, thus allowing, for example, for multiple wafers to be processed at once. In the same or another embodiment, semiconducting wafer 130 and magnetic film 140 together have a height 139, and height 125 and height 126 are each at least as great as height 139. Similarly, permanent magnetic bar 121 has a depth 127 and permanent magnetic bar 122 has a depth 128, while semiconducting wafer 130 has a depth (or diameter) 137. In one embodiment, depth 127 and depth 128 are each at least as great as depth 137.

Figure 2:
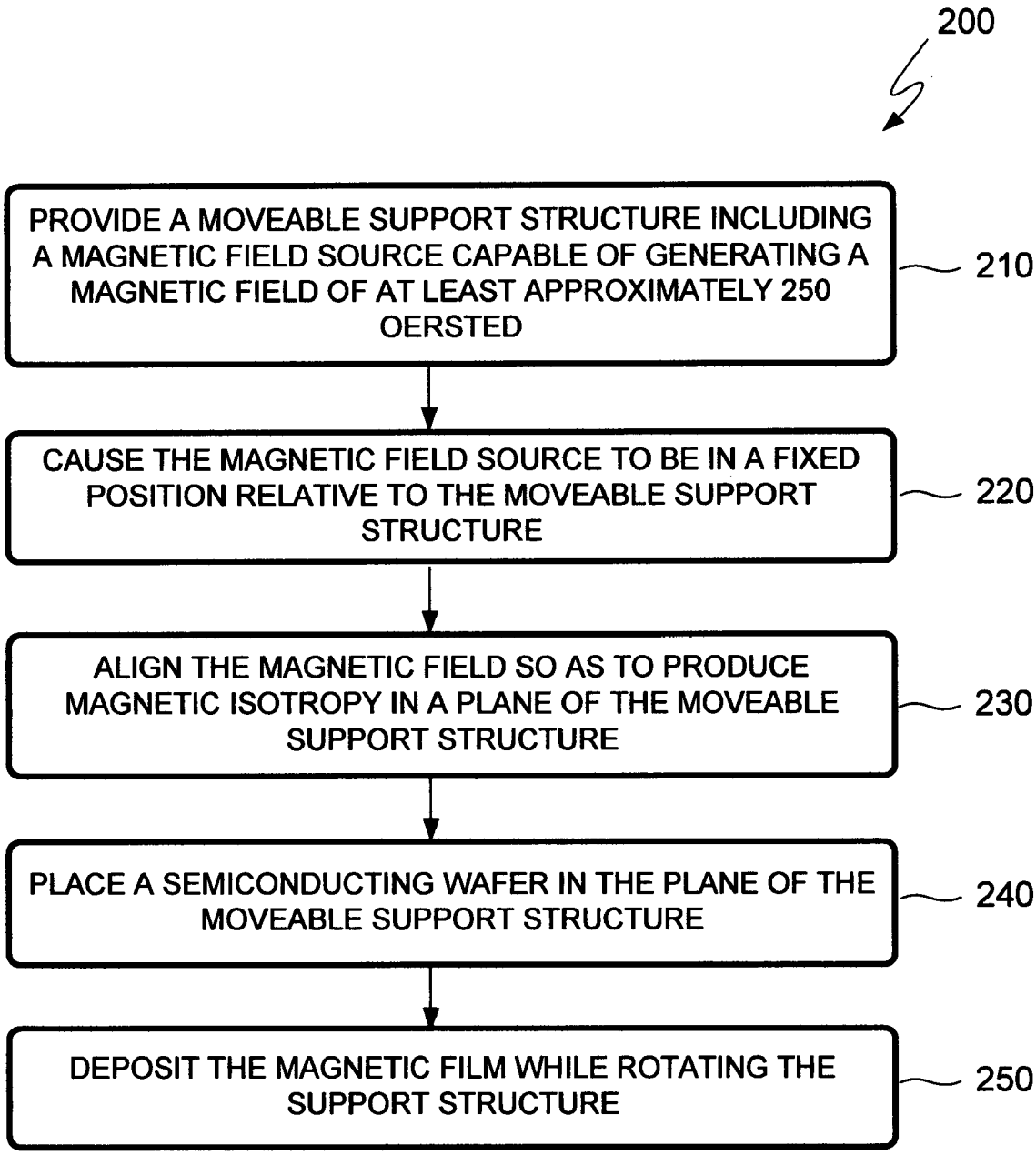
FIG. 2 is a flowchart illustrating a method of producing an aligned magnetic field in a magnetic film according to an embodiment of the invention.

FIG. 2 is a flowchart illustrating a method 200 of producing an aligned magnetic field in a magnetic film according to an embodiment of the invention. A step 210 of method 200 is to provide a moveable support structure including a magnetic field source capable of generating a magnetic field at a wafer surface of at least approximately 50 Oersted. As an example, the moveable support structure can be similar to moveable support structure 110 that is shown in FIG. 1. As another example, the magnetic field source can be similar to magnetic field source 120 that is also shown in FIG. 1.

A step 220 of method 200 is to cause the magnetic field source to be in a fixed position relative to the moveable support structure.

A step 230 of method 200 is to align the magnetic field so as to produce magnetic anisotropy in a plane of the moveable support structure.

A step 240 of method 200 is to place a semiconducting wafer in the plane of the moveable support structure. As an example, the semiconducting wafer can be similar to semiconducting wafer 130 that is shown in FIG. 1.

A step 250 of method 200 is to deposit the magnetic film while rotating the support structure. As an example, the magnetic film can be similar to magnetic film 140 that is shown in FIG. 1. In one embodiment, step 250 comprises depositing a film comprising cobalt. In the same or another embodiment, step 250 comprises depositing a cobalt-tungsten-boron film. In the same or another embodiment, step 250 comprises electrolessly depositing the magnetic film.

Although the invention has been described with reference to specific embodiments, it will be understood by those skilled in the art that various changes may be made without departing from the spirit or scope of the invention. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the apparatus and related methods and systems discussed herein may be implemented in a variety of embodiments, and that the foregoing discussion of certain of these embodiments does not necessarily represent a complete description of all possible embodiments.

Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An apparatus capable of producing a moveable magnetic field, the apparatus comprising:

a moveable support structure; a semiconductor wafer supported by and held within a plane of the moveable support structure, the semiconducting wafer having a first side and an opposing second side; and a magnetic field source directly attached to and in a fixed position relative to the moveable support structure such that it moves in tandem with the moveable support structure, wherein:

the magnetic field source comprises a first permanent magnetic bar located at the first side of the semiconducting wafer and a second permanent magnetic bar located at the second side of the semiconducting wafer;

the first permanent magnetic bar has a first axis with a north pole at a first end thereof and a south pole at an opposing second end thereof;

the second permanent magnetic bar has a second axis with a north pole at a first end thereof and a south pole at an opposing second end thereof;

the first permanent magnetic bar and the second permanent magnetic bar are aligned in attraction with each other;

the first permanent magnetic bar has a first height and a first depth and the second permanent magnetic bar has a second height and a second depth;

the semiconducting wafer has a third height and a third depth;

the first height and the second height are each at least as great as the third height;

the first depth and the second depth are each at least as great as the third depth;

the magnetic field source generates a magnetic field of at least 50 Oersted; and the magnetic field is aligned so as to produce magnetic anisotropy in the plane of the moveable support structure.

2. The apparatus of claim 1 wherein:

the magnetic field source is a permanent magnet.

3. The apparatus of claim 1 wherein:

the magnetic field source is an electromagnet.

4. The apparatus of claim 1 further comprising a magnetic film on the semiconducting wafer.

5. The apparatus of claim 4, wherein the magnetic film has a coercivity of less than 1.0 Oersted.

6. The apparatus of claim 4, wherein the magnetic film comprises cobalt and at least one of tungsten, boron, iron, and phosphorus.

* * * * *